US009138057B2

(12) United States Patent
Furutani

(10) Patent No.: US 9,138,057 B2
(45) Date of Patent: Sep. 22, 2015

(54) MASSAGE CHAIR

(71) Applicant: FUJI MEDICAL INSTRUMENTS MFG. CO., LTD, Osaka (JP)

(72) Inventor: Takeshi Furutani, Osaka (JP)

(73) Assignee: FUJI MEDICAL INSTRUMENTS MFG. CO., LTD, Osaka (JP)

( * ) Notice: Subject to any disclaimer, the term of this patent is extended or adjusted under 35 U.S.C. 154(b) by 23 days.

(21) Appl. No.: 14/102,160

(22) Filed: Dec. 10, 2013

(65) Prior Publication Data

US 2014/0159454 A1 Jun. 12, 2014

(30) Foreign Application Priority Data

Dec. 11, 2012 (JP) ..... 2012-269909

(51) Int. Cl.
*A47C 1/03* (2006.01)
*A47C 1/035* (2006.01)

(52) U.S. Cl.
CPC . *A47C 1/035* (2013.01); *A47C 1/03* (2013.01); *A61H 2201/0149* (2013.01); *A61H 2201/0192* (2013.01); *A61H 2201/1623* (2013.01); *A61H 2201/1635* (2013.01); *A61H 2205/06* (2013.01); *A61H 2205/081* (2013.01)

(58) Field of Classification Search
CPC ..... A47C 1/03
USPC ..... 297/78, 81, 411.35; 601/49, 92, 98
See application file for complete search history.

(56) References Cited

U.S. PATENT DOCUMENTS

| | | | | |
|---|---|---|---|---|
| 5,655,814 | A * | 8/1997 | Gibbs | 297/411.38 |
| 6,079,787 | A * | 6/2000 | Nichols et al. | 297/411.39 |
| 7,708,340 | B2 * | 5/2010 | Tanizawa et al. | 297/217.3 |
| 8,596,722 | B2 * | 12/2013 | Haubrich et al. | 297/411.37 |
| 2006/0142676 | A1 * | 6/2006 | Fujii et al. | 601/98 |
| 2007/0114829 | A1 * | 5/2007 | Wieczorek et al. | 297/411.35 |
| 2011/0077563 | A1 * | 3/2011 | Fukuyama | 601/98 |

FOREIGN PATENT DOCUMENTS

JP 2008-178491 A 8/2008

* cited by examiner

*Primary Examiner* — Peter Brown
(74) *Attorney, Agent, or Firm* — Osha Liang LLP

(57) ABSTRACT

A massage chair includes a seat for allowing a subject for treatment to sit thereon; a reclinable backrest; left and right arm treatment sections provided for treating arms; a base frame; a seat rail, provided at each of a top left end and a top right end of the base frame, for supporting a seat frame as a framework of the seat such that the seat frame is movable in a front-rear direction; an arm rail for supporting an arm support as a framework of each arm treatment section, such that the arm support is movable in the front-rear direction; and an association mechanism, provided between the seat frame and each arm support, for, when the seat frame is moved forward along with a reclination of the backrest, converting the forward movement of the seat frame into the rearward movement of the arm support.

8 Claims, 7 Drawing Sheets

MASSAGE CHAIR

BACKGROUND OF THE INVENTION

1. Field of the Invention

The present invention relates a massage chair for massaging a human body sitting thereon, and more specifically to a massage chair for massaging an arm of the human body in a favorable manner even when a backrest is reclined.

2. Description of the Prior Art

A massage chair for massaging an arm of a human body is described in, for example, Patent Document 1.

The massage chair described in the above-identified publication is conceived with an attention being paid to the following problem. When a backrest of a massage chair is reclined, both of the shoulders of a human body sitting thereon are moved rearward and along therewith, arms thereof are also moved rearward. As a result, a treatment on the arms cannot be performed at a prescribed proper position. The massage chair described in the above-identified publication is structured such that when the backrest thereof is reclined or raised back, arm treatment sections follow such a movement of the backrest. More specifically, the arm treatment sections are provided in connection to the backrest so as to be movable rearward on left and right upright side walls of a base of the massage chair.

With the above-described structure, the arm treatment sections are moved rearward along with the reclination of the backrest. Therefore, it may be considered that the positions of treatment on the arms are not shifted.

However, when the backrest is reclined, the shoulders of a human body move a relatively long distance and the movement thereof is not straight. Therefore, the structure of moving only the arm treatment sections on the upright walls of the base does not allow the arm treatment sections to follow the movement of the backrest sufficiently, and thus is not considered to sufficiently solve the problem of the shift of the positions of treatment.

PRIOR ART DOCUMENT

Patent Document

Patent Document 1: Japanese Laid-Open Patent Publication No. 2008-178491

SUMMARY OF THE INVENTION

Problems to be Solved by the Invention

Thus, the present invention has an object of allowing an arm treatment section to follow the reclination of a backrest and thus suppress a shift of a position of treatment on an arm to a minimum possible distance.

Solutions for the Problems

In order to achieve the object, a massage chair includes a seat for allowing a subject for treatment to sit thereon; a reclinable backrest; left and right arm treatment sections provided for treating arms; a base frame; a seat rail provided at each of a top left end and a top right end of the base frame, the seat rail being provided for supporting a seat frame, acting as a framework of the seat, such that the seat frame is movable in a front-rear direction; an arm rail for supporting an arm support acting as a framework of each of the arm treatment sections, such that the arm support is movable in the front-rear direction; and an association mechanism provided between the seat frame and each of the arm supports, the association mechanism being provided for, when the seat frame is moved forward along with a reclination of the backrest, converting the forward movement of the seat frame into the rearward movement of the arm support.

In this specification the term "arm" encompasses a "hand" beyond the wrist.

According to this structure, as the backrest is reclined, the seat frame included in the seat is moved forward along the seat rails. Therefore, the shift between the position of the arm when the backrest is reclined and the position of the arm when the backrest is not reclined is made small. In addition, the association mechanism converts the forward movement of the seat frame into a rearward movement of the arm support included in the arm treatment section, and thus moves the arm treatment section rearward along the arm rail.

Effect of the Invention

According to the present invention, the massage chair includes the seat movable forward along with the reclination of the backrest, and the association mechanism for converting the forward movement of the seat into a rearward movement of the arm treatment section. Therefore, the shift between the position of the arm when the backrest is reclined and the position of the arm when the backrest is not reclined is made small. In addition, such a small shift is compensated for by moving the arm treatment section via the association mechanism. Owing to this, the arm treatment section can sufficiently follow the reclination of the backrest as compared with a case where the positional offset of the arms with respect to the arm treatment section is solved only by the movement of the arm treatment section. In addition, since the arm treatment section needs to move merely a short distance, the association mechanism can be provided with a simple structure.

DESCRIPTION OF THE PREFERRED EMBODIMENTS

Hereinafter, an embodiment of the present invention will be described with reference to the drawings.

Figure 1:
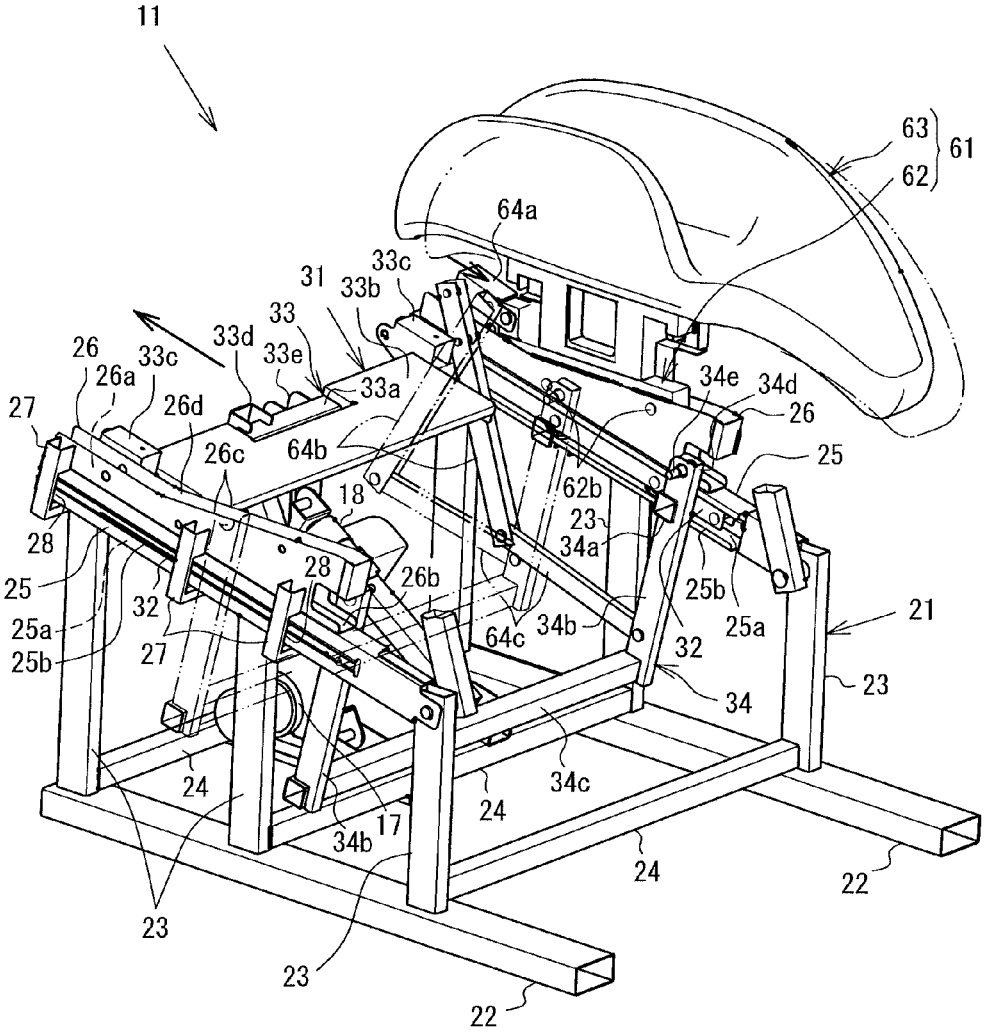
FIG. 1 is a partial isometric view showing an internal structure of a massage chair.
Figure 2:
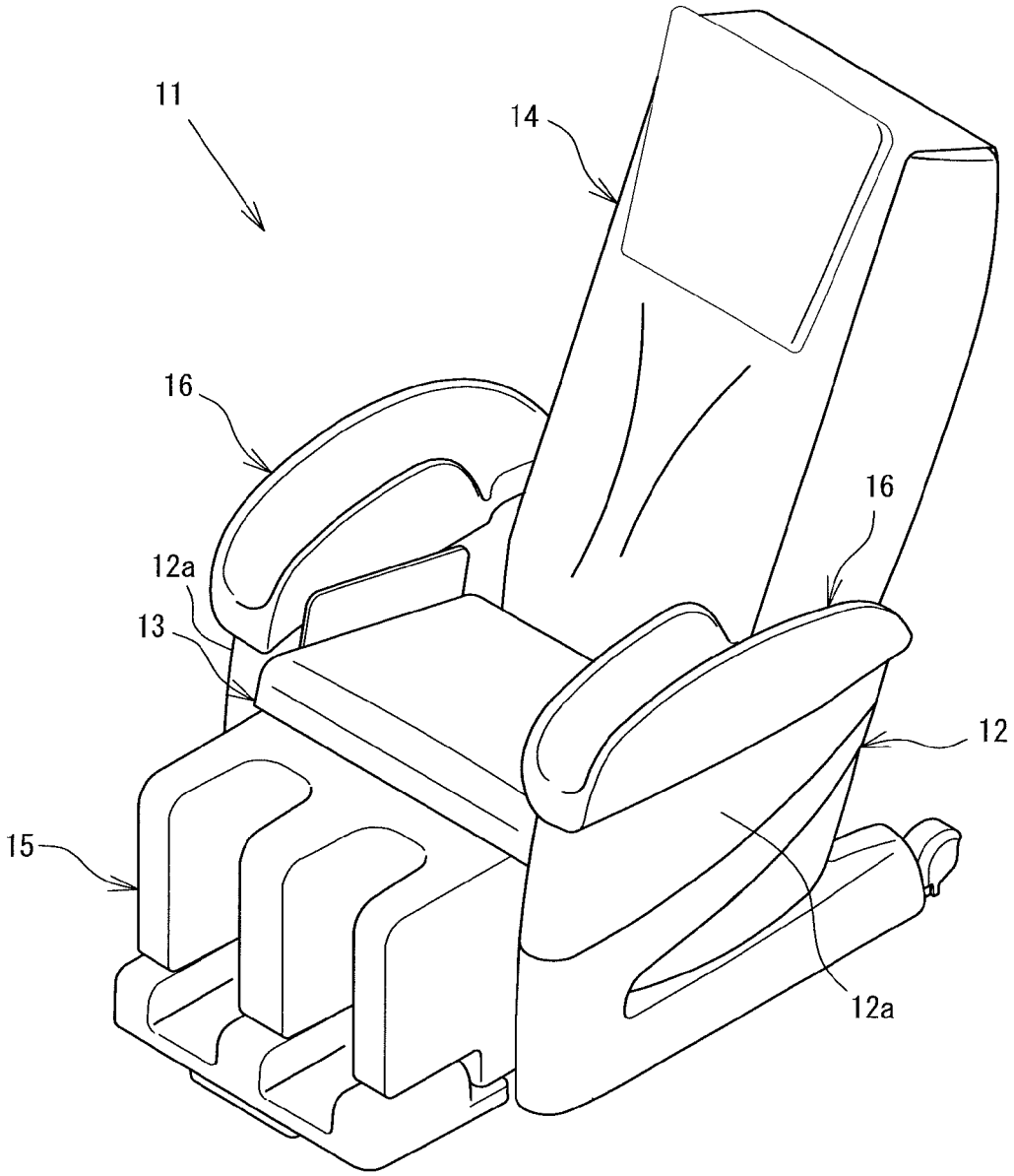
FIG. 2 is an isometric view of the massage chair.

FIG. 1 is a partial isometric view showing an internal structure of a massage chair 11. As shown in FIG. 2, the massage chair 11 includes a base 12, a seat 13 on which a subject for treatment can sit, a reclinable backrest 14 provided along a rear end of the seat 13, a leg treatment section 15 provided along a front end of the seat 13 and capable of being raised upward, and arm treatment sections 16 provided for treating arms, the arm treatment sections 16 being provided at top ends of left and right side walls 12*a* of the base 12.

The base 12 has a built-in base frame 21 shown in FIG. 1 as a framework, and supports the seat 13, the backrest 14 and the arm treatment sections 16.

The base frame 21 is formed by assembling square or rectangular steel pipes. The base frame 21 includes two, namely, left and right, bottom members 22 extending in a front-rear direction, a plurality of vertical members 23 standing on each of the bottom members 22, and lateral members 24 each extending in a left-right direction between bottom ends of the vertical members 23. The vertical members 23 correspond to the left and right side walls 12*a* of the massage chair 11.

Figure 3:
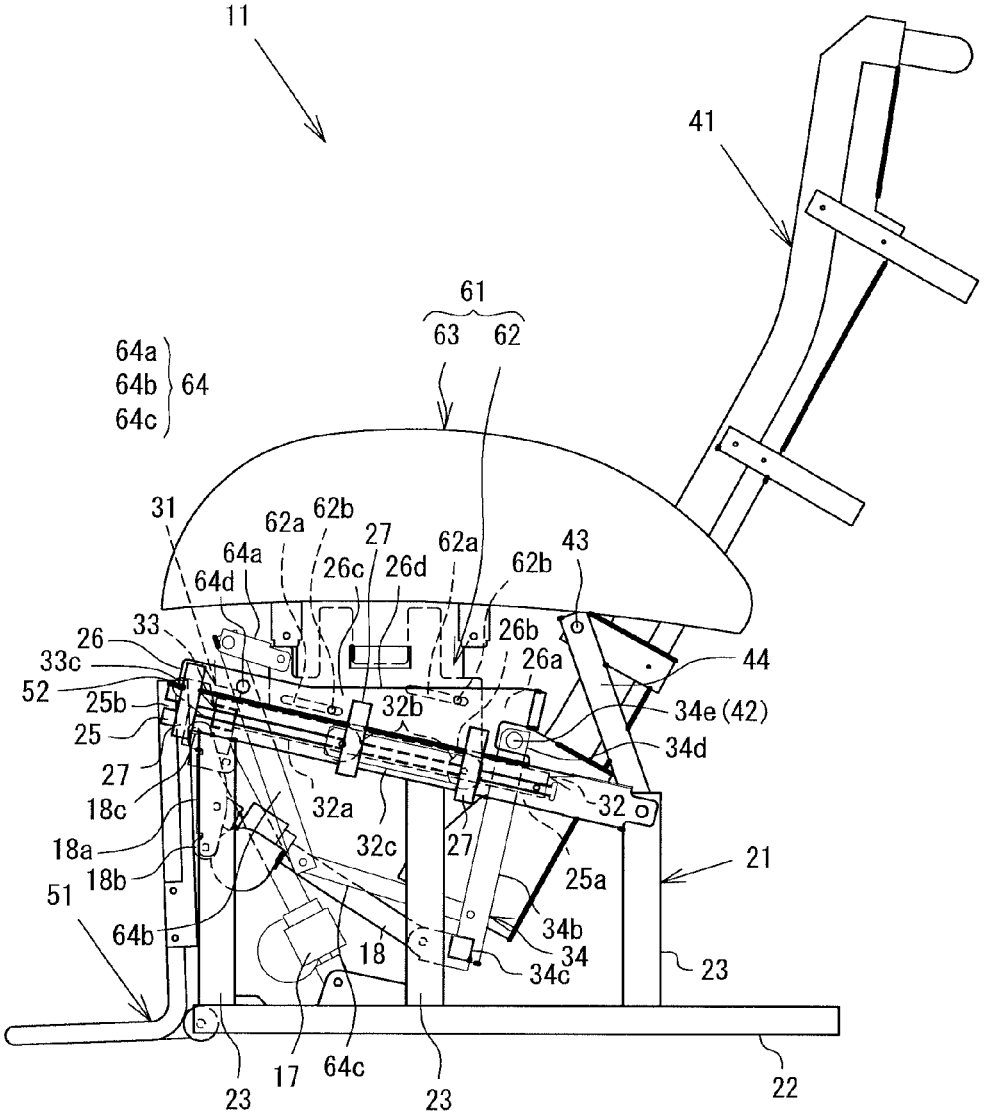
FIG. 3 is a schematic side view showing an internal structure of the massage chair.

As shown in FIG. 1 and FIG. 3, the plurality of vertical members 23 are structured so as to be longer as being closer to a front end of the massage chair 11. Namely, a phantom straight line connecting top ends of the plurality of vertical members 23 is inclined so as to be lower as being closer to a rear end of the massage chair 11. On these vertical members 23, the seat 13 and the arm treatment sections 16 are movably supported.

The seat 13 is supported by seat rails 25 fixed to the top ends of the vertical members 23. The arm treatment sections 16 are supported by arm rails 26 stacked on the seat rails 25.

Each of the seat rails 25 is formed of a square or rectangular steel pipe, and includes a running groove 25*a* opened leftward or rightward. More specifically, the running groove 25*a* of the left seat rail 25 is opened leftward, and the running groove 25*a* of the right seat rail 25 is opened rightward. An opening 25*b* of each of the running grooves 25*a* is lengthy and extends from a front end of the seat rail 25 to an appropriate position in a rear part thereof. The opening 25*b* extends over a length necessary for the seat rail 25 to support the seat 13. The opening 25*b* has a width smaller than the width of the seat rail 25.

Each of the arm rails 26 is formed of a pressed metal plate and includes a running groove 26*a* opened upward. A bottom plate 26*b* of the arm rail 26 is planar so as to be stacked on a top surface of the seat rail 25. Side plates 26*c* of the arm rail 26 are designed to have a certain height from the bottomplate 26*b* in front part thereof. Ina rear part thereof, the side plates 26*c* are designed to become gradually higher from the bottom plate 26*b* as being closer to a rear end thereof. Namely, in the rear part of the arm rail 26, the running groove 26*a* becomes gradually deeper. The running groove 26*a* of the arm rail 26 is opened at a front end thereof and is closed at a rear end thereof. The running groove 26*a* is opened upward and thus has an opening 26*d* which extends from the front end to the rear end thereof.

On an outer side surface of each of the seat rails 25 and the corresponding arm rail 26, a plurality of reinforcing members 27 are provided for keeping the width of the opening 25*b* of the seat rail 25 and for fixing the seat rail 25 and the arm rail 26 to each other. The reinforcing members 27 are attached to be perpendicular to the seat rail 25 and the arm rail 26. A part of each reinforcing member 27 that corresponds to the opening 25*b* of the seat rail 25 is formed so as to float from the side surface of the seat rail 25, and thus there is a gap 28 between the side surface of the seat rail 25 and the reinforcing member 27.

Figure 4:
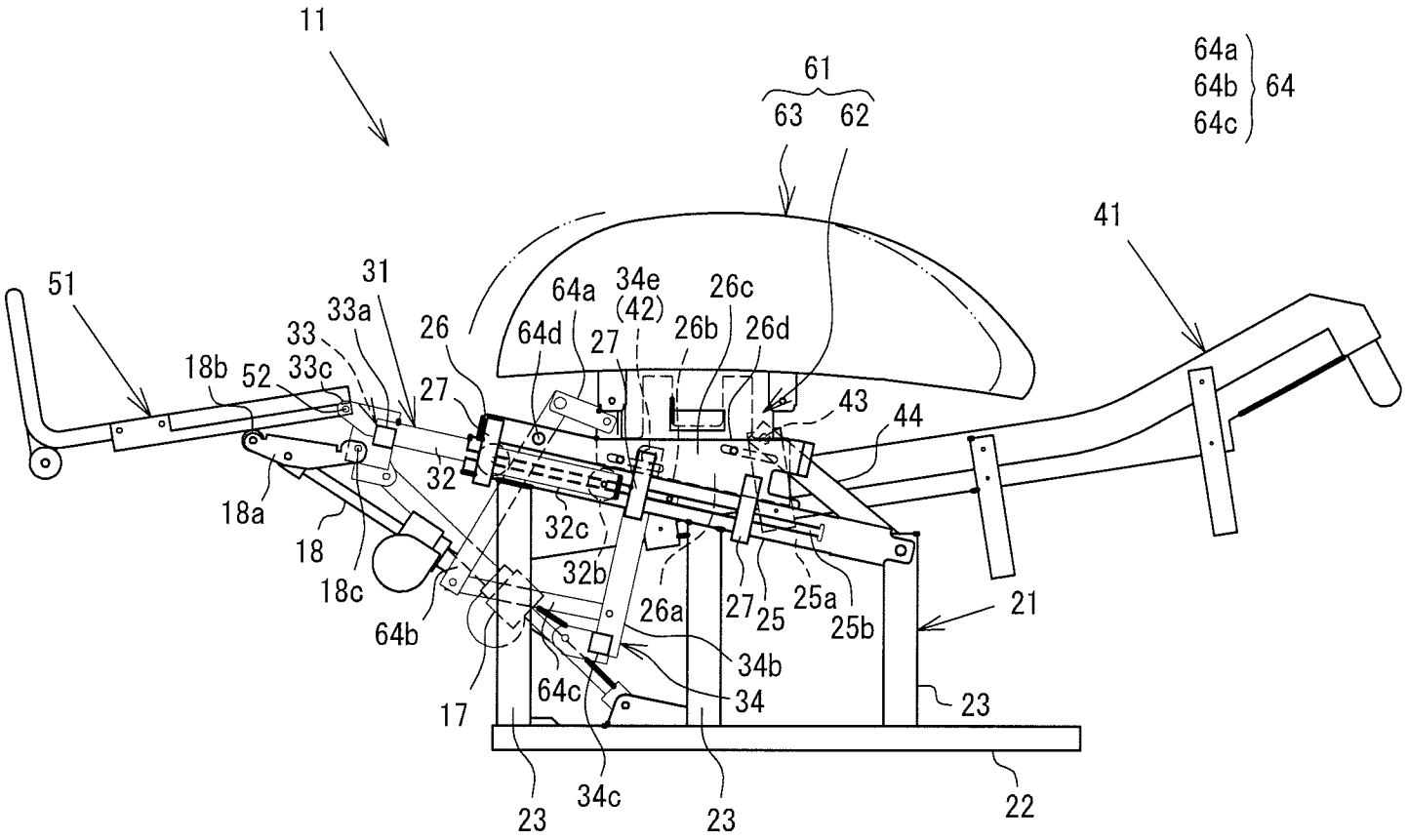
FIG. 4 is a schematic side view showing an internal structure of the massage chair when a backrest thereof is reclined.
Figure 5:
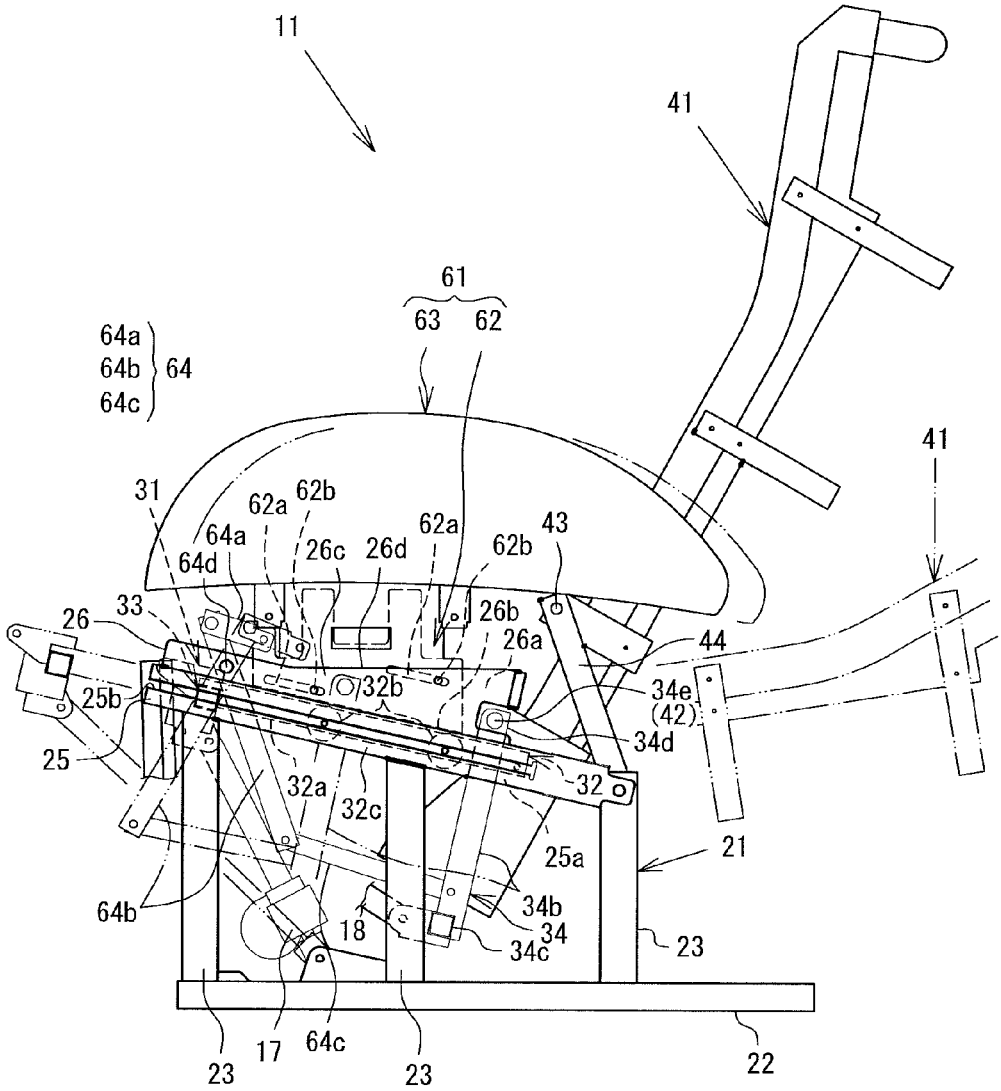
FIG. 5 is a side view showing an operation of a part of the internal structure of the massage chair.

The seat 13 includes a seat frame 31 acting as a framework. As shown in FIG. 4 and FIG. 5, the seat frame 31 is supported between the seat rails 25 so as to be movable forward along with the reclination of the backrest 14. The seat frame 31 includes running bodies 32 capable of running in the running grooves 25*a* of the seat rails 25, and lateral bodies 33 and 34 provided at a front end and a rear end of the seat frame 31 between the running bodies 32.

Each of the running bodies 32 includes two lengthy rectangular running plates 32*a* and a plurality of running wheels 32*b* provided between the running plates 32*a*. Namely, the running plates 32*a* are planar and are provided parallel to each other while the planar surfaces thereof face each other in a width direction of seat rail 25. The running wheels 32*b* are rotatably held between the running plates 32*a* while partially being protruded from bottom ends of the running plates 32*a*. The running bodies 32 each include an integral regulation plate 32*c* which is movable in the gap 28 formed between the outer side surface of the seat rail 25 and each reinforcing member 27 (see FIG. 3).

Among the lateral bodies 33 and 34, the lateral body 33 provided at the front end of the massage chair 11 includes a lateral member 33*a* having both of two ends fixed to the running plates 32*a* and formed of a square or rectangular steel pipe, a lateral plate 33*b* provided on a top surface of the lateral member 33*a* so as to protrude rearward, leg support connecting parts 33*c* respectively provided at both of two ends of the lateral member 33*a*, and two driving unit connecting parts 33*d* and 33*e* provided side by side in an intermediate part of the lateral member 33*a*.

Among the lateral bodies 33 and 34, the lateral body 34 provided at the rear end of the massage body 11 includes short cylindrical fixed parts 34*a* each formed of a square or rectangular steel pipe, hung parts 34*b* unrotatably integrated with the fixed portions 34*a* respectively and extending downward among directions perpendicular to the running bodies 32, and a lateral part 34*c* for integrally coupling bottom ends of the hung parts 34*b*. At a top end of each of the hung parts 34*b*, an extending part 34*d* slightly extending upward is provided. At a tip of the extending part 34*d*, a rotatable shaft 34*e* for rotatably coupling the backrest 14 to the extending part 34*d* is protruded inward in the left-right direction. The rotatable shaft 34*e* is located at a position corresponding to a central position of the human body sitting on the massage chair 11, more specifically, at a position corresponding to a position in the vicinity of the center, in the front-rear direction, of the hypogastric region of the human body sitting on the massage chair 11.

To the seat frame 31 having such a structure, an appropriate member necessary for supporting the buttocks and the femoral region of the human body is attached together with an appropriate massage unit. The massage unit is formed of an appropriate member such as an airbag, massaging balls or the like. Massage units described below are also formed of such an appropriate member.

Among the driving unit connecting parts 33*d* and 33*e*, the driving unit connecting part 33*d* acts as a reclining coupling part 33*d* to which one of two ends of a reclining extension/contraction mechanism 17 is rotatably coupled. The reclining extension/contraction mechanism 17 acts as a driving unit for reclining the backrest 14. The other end of the reclining extension/contraction mechanism 17 is rotatably coupled to the base frame 21.

The driving unit connecting part 33*e* acts as a leg-raising coupling part 33*e* to which the leg treatment section 15 is coupled.

As shown in FIG. 3, the backrest 14 includes a back frame 41 acting as a framework and another necessary member such as a massage unit or the like. The back frame 41 includes a pivotable part 42 at a bottom front position thereof. The pivotable part 42 is coupled to the rotatable shafts 34*e* of the seat frame 31, and thus the backrest 14 is kept to be held by the seat frame 31.

Above the pivotable part 42 of the back frame 41, a supporting pivotable part 43 is provided. To the supporting pivotable part 43, supporting rods 44 are rotatably coupled. Bottom ends of the supporting rods 44 are rotatably attached to the top ends of the vertical members 23 provided at a rear end of the base frame 21.

Figure 6:
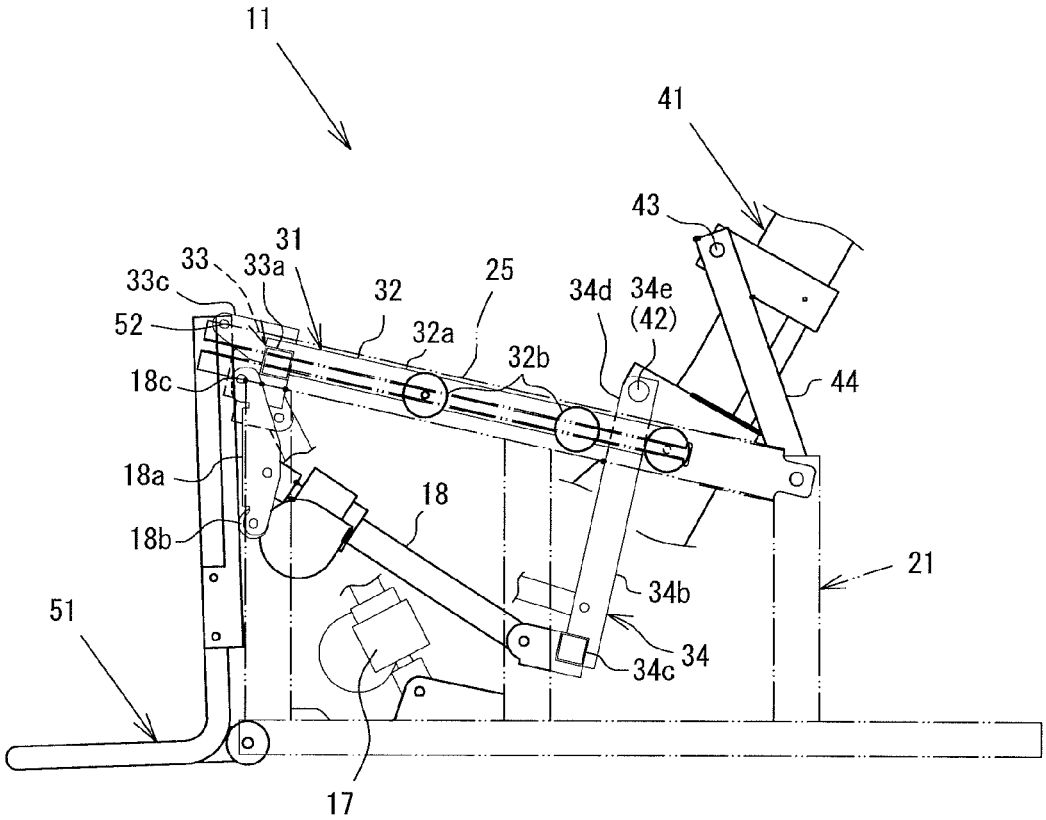
FIG. 6 is a schematic side view showing an internal structure of a leg treatment section of the massage chair.

The leg treatment section 15 includes a leg frame 51 acting as a framework and another necessary member such as a massage unit or the like. As shown in FIG. 6, the leg frame 51 is formed to be generally L-shaped as seen in a side view, and includes pivotable parts 52 at a top left end and a top right end thereof. The pivotable parts 52 are rotatably coupled to the leg support connecting parts 33*c* of the seat frame 31.

A leg-raising extension/contraction mechanism 18, having one of two ends attached to the leg-raising coupling part 33*e* provided at the front end of the seat 13, acts as a driving unit for rotating the leg frame 51. As shown in FIG. 6, the other end of the leg-raising extension/contraction mechanism 18 is rotatably attached to the lateral part 34*c* connected to the bottom ends of the hung parts 34*b* provided at the rear end of the seat 13. Namely, the leg treatment section 15 is rotated by the driving unit provided in the seat 13 (leg-raising extension/contraction mechanism 18) which moves forward along with the reclination of the backrest 14.

At a tip of the leg-raising extension/contraction mechanism 18, a push-up member 18*a* is rotatably provided. One of two ends of the push-up member 18*a* is pivotably attached to a bottom end of the seat frame 31. This end will be referred to as a "part 18*c*". At the other end of the push-up member 18*a*, a rotatable roller 18*b* is provided. Thus, as shown in FIG. 4 and FIG. 5, when the leg-raising extension/contraction mechanism 18 is driven to extend, the push-up member 18*a* pushes a rear surface of the leg frame 51 by the rotatable roller 18*b* while rotating about the part 18*c*. Thus, the push-up member 18*a* rotates the leg frame 51 in a direction in which the leg frame 51 is raised.

Each arm treatment section 16 includes an arm support 61 acting as a framework and another necessary member such as a massage unit or the like. The arm support 61 includes a plate-like running body 62 which can run in the running groove 26*a* of the arm rail 26 and an arm carrying part 63 provided at a top end of the running body 62 and having a generally U-shaped vertical cross-section. The running body 62 has a bottom end inclining in correspondence with the bottom plate 26*b* of the arm rail 26 and supports the arm carrying part 63 generally horizontally.

As shown in FIG. 5, a part of the running body 62 that is accommodated in the arm rail 26 has lengthy holes 62*a* extending while inclining at the same angle as the bottom plate 26*b* of the arm rail 26. Withdrawal-preventing pins 62*b* running through the arm rail 26 in the left-right direction are respectively inserted into the lengthy holes 62*a*, and thus the movable range in the front-rear direction of the running body 62 is restricted.

To a front end of the running body 62, a short upper coupling rod 64*a* is pivotably attached. The upper coupling rod 64*a* is a part of an association mechanism 64. When the seat frame 31 is moved forward along with the reclination of the backrest 14, the association mechanism 64 converts the forward movement of the seat frame 31 into a rearward movement of the arm support 61.

The upper coupling rod 64*a* is rotatably coupled to a top end of an inclinable rod 64*b* having an intermediate part pivotably attached to a front part of the arm rail 26 provided at a top end of the base frame 21. To a bottom end of the inclinable rod 64*b*, one of two ends of a lower coupling rod 64*c* is pivotably attached. The other end of the lower coupling rod 64*c* is rotatably coupled to the hung part 34*b* of the seat frame 31. In FIG. 3, FIG. 4 and FIG. 5, reference numeral 64*d* represents the intermediate part of the inclinable rod 64*b* at which the inclinable rod 64*b* is pivotably attached to the front part of the arm rail 26.

The upper coupling rod 64*a*, the inclinable rod 64*b*, and the lower coupling rod 64*c* are included in the association mechanism 64. These parts of the association mechanism 64 each have a size and a shape which are set such that when the seat frame 31 is moved forward, the arm support 61 is moved rearward by a desired distance.

The massage chair 11 having the above-described structure is operated as follows. When the reclining extension/contraction mechanism 17 is controlled to be driven such that the seat 13 is located at a rear position, the backrest 14 (back frame 41) is at a raised position as represented by the solid line in FIG. 5. The human body sitting on the massage chair 11 can have an arm thereof put on the arm treatment section 16 (arm support 61) and have the arm massaged at a posture in a relaxed state.

When it is wished to perform a massage in a state where the backrest 14 is reclined, the reclining extension/contraction mechanism 17 is driven to move the seat 13 forward. Along with this movement, the backrest 14 is reclined and supports the human body. Since the seat 13 is moved forward, a rearward displacement amount (amount of positional offset) of the arm of the human body can be suppressed small. One of reasons for this is that the center of the human body sitting on the massage chair 11 and the rotation center of the backrest 14 are close to each other. As a result of the suppressed rearward displacement amount, the positional offset of the arm from the position of the arm treatment section 16 is made small. Such a small positional offset is absorbed by the following manner. When the seat 13 is moved forward, the lower coupling rod 64*c* pushes forward the bottom end of the inclinable rod 64*b*. As a result, the inclinable rod 64*b* is pivoted about the pivotable part 64*d* and therefore, a top end of the inclinable rod 64*b* is reclined. Thus, the upper coupling rod 64*a* retracts the arm treatment section 16 (arm support 61). The small shift can be absorbed in this manner.

The massage chair 11 includes the seat 13 movable forward along with the reclination of the backrest 14, and the association mechanism 64 for converting the forward movement of the seat 13 into a rearward movement of the arm treatment section 16. Owing to this, the arm treatment section 16 can sufficiently follow the reclination of the backrest 14 as compared with a case where the positional offset of the arm with respect to the arm treatment section 16 is absorbed only by the movement of the arm treatment section 16.

For raising the backrest 14, the reclining extension/contraction mechanism 17 is driven to move the seat 13 rearward. Thus, the backrest 14 is raised and the association mechanism 64 positively pulls forward the arm treatment section 16. Namely, the association mechanism 64 is operated for raising the backrest 14 in addition to for reclining the backrest 14, and positively pulls the arm treatment section 16. Therefore, the operation of returning the backrest 14 to the original, raised state is performed smoothly. This contributes to a comfortable massage.

The seat rail 25 and the arm rail 26 are structured to be stacked on each other as a lower layer and an upper layer, and the seat rail 25 includes the running groove 25*a* opened leftward or rightward, and the arm rail 26 includes the running groove 26*a* opened upward. Owing to this, the association mechanism 64 is provided at a position along an inner side surface of the seat rail 25 and the arm rail 26, and thus can be provided with a simple structure.

The association mechanism 64 includes the inclinable rod 64*b* and the two coupling rods (upper coupling rod 64*a* and the lower coupling rod 64*c*). This structure reduces the number of components of the massage chair and allows an adjustment of the retracting distance of the arm treatment section 16 and other settings to be performed easily.

The backrest 14 is reclined in a rotating manner while being pulled forward by the seat 13. This structure requires only one driving unit for reclining and thus reduces the number of components of the massage chair 11. The protrusion length of the backrest 14 when the backrest 14 is reclined can be suppressed small. Owing to this, the space provided rearward to the massage chair 11 can be small, which leads to effective utilization of space. In other words, the massage chair 11 can be set even when the space rearward thereto is small.

The leg-raising extension/contraction mechanism 18 for rotating the leg treatment section 15 is provided in the seat 13 movable in the front-rear direction. Therefore, the rotation operation of the leg treatment section 15 can be performed smoothly and controlled easily regardless of the position in the front-rear direction of the seat 13.

Hereinafter, another example will be described. In the following description, elements identical or equivalent to those in the above-described example will bear identical reference numerals thereto and details descriptions thereof will be omitted.

Figure 7:
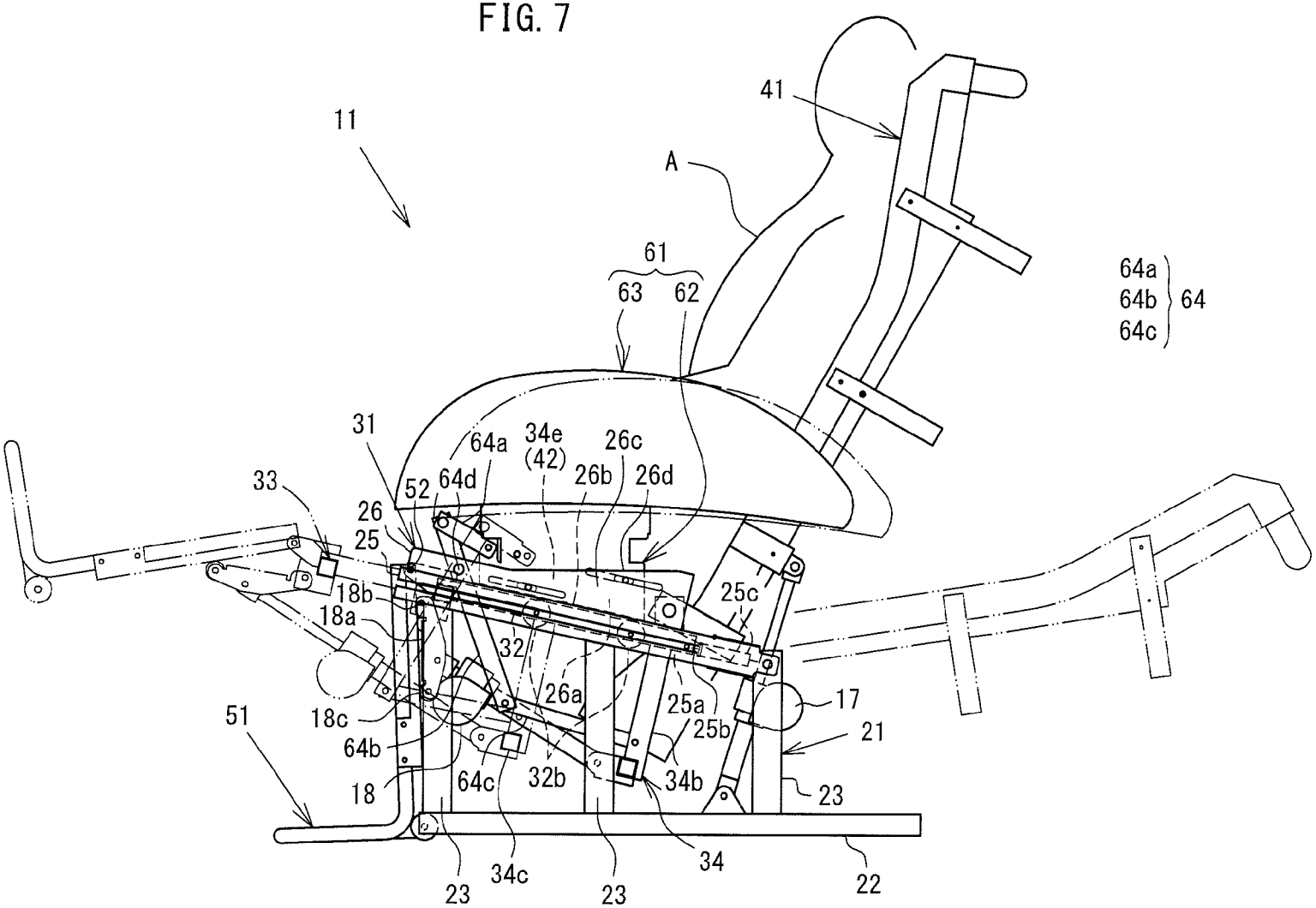
FIG. 7 is a schematic side view showing an internal structure of a massage chair in another example.

FIG. 7 is a schematic side view showing a structure of a massage chair 11 in another example. In the massage chair 11, the reclination of the back frame 41 is performed separately from the forward movement of the seat frame 31. More specifically, the back frame 41 is directly coupled to the reclining extension/contraction mechanism 17 acting as a driving unit for reclining the back frame 41.

The seat frame 31 does not include any driving unit but is moved as follows. When the back frame 41 is reclined, a human body A sitting on the massage chair 11 is shifted forward. Owing to the load generated by the forward shift, the seat frame 31 is moved forward along with the reclination of the back frame 41. A spring 25*c* as an urging unit for urging the seat frame 31 rearward is provided in the seat rail 25, so that the seat frame 31 is smoothly returned to the original position when the back frame 41 is raised back.

The massage chair 11 having such a structure also provides substantially the same functions and effects as described above.

Although not shown in the figures, the massage chair 11 may include a driving unit for moving the seat frame 31 forward in addition to the driving unit for reclining the back frame 41, and these driving units may be controlled to be associated with each other.

In the above-described structure in which the seat frame 31 is movable forward along with the reclination of the backrest 14, the reclining extension/contraction mechanism 17 is coupled to the seat frame 31. Alternatively, although not shown, the reclining extension/contraction mechanism 17 may be coupled to the back frame 41.

The coupling rod of the present invention corresponds to the upper coupling rod 64*a* or the lower coupling rod 64*c* of the embodiment described above; and similarly, the driving unit for moving the seat frame in the front-rear direction corresponds to the reclining extension/contraction mechanism 17.

However, the present invention is not limited to having the above-described structure, and may be embodied in any other appropriate structure.

DESCRIPTION OF THE REFERENCE NUMERALS

11 . . . Massage chair
13 . . . Seat
14 . . . Backrest
16 . . . Arm treatment section
17 . . . Reclining extension/contraction mechanism
21 . . . Base frame
25 . . . Seat rail
25*a* . . . Running groove
25*b* . . . Opening
26 . . . Arm rail
26*a* . . . Running groove
26*d* . . . Opening
31 . . . Seat frame
41 . . . Back frame
61 . . . Arm support
64 . . . Association mechanism
64*a* . . . Upper coupling rod
64*b* . . . Inclinable rod
63*c* . . . Lower coupling rod

What is claimed is:

1. A massage chair, comprising:

a seat for allowing a subject for treatment to sit thereon;

a reclinable backrest;

left and right arm treatment sections provided for treating arms;

a base frame;

a seat rail provided at each of a top left end and a top right end of the base frame, the seat rail being provided for supporting a seat frame, acting as a framework of the seat, such that the seat frame is movable in a front-rear direction;

an arm rail for supporting an arm support acting as a framework of each of the arm treatment sections, such that the arm support is movable in the front-rear direction; and an association mechanism comprising: an inclinable rod having a top end and a bottom end; an upper coupling rod coupled to the top end of the inclinable rod; and a lower coupling rod coupled to the bottom end of the inclinable rod, the association mechanism being provided between the seat frame and each of the arm supports, wherein, when the seat frame moves forward as the backrest reclines, the association mechanism converts the forward movement of the seat frame into the rearward movement of the arm support.

2. A massage chair according to claim 1, wherein the inclinable rod of the association mechanism further comprises an intermediate part pivotably supported by a top end of the base frame, or to a part in a vicinity of the top end of the base frame, wherein when the seat is moved forward, the lower coupling rod pushes the bottom end of the inclinable rod forward, causing the inclinable rod to pivot about the intermediate part, thereby causing the top end of the inclinable rod to recline.

3. A massage chair according to claim 2, wherein the seat rail includes a first running groove, which is opened laterally and allows the seat frame to run therein, and wherein the arm rail includes a second running groove, which is opened vertically and allows the arm support to run therein, and is stacked on the seat rail.

4. A massage chair according to claim 3,
wherein the seat frame includes a driving unit for moving the seat frame in the front-rear direction, and
wherein a back frame acting as a framework of the backrest is pivotably attached to the seat frame.

5. A massage chair according to claim 2,
wherein the seat frame includes a driving unit for moving the seat frame in the front-rear direction, and
wherein a back frame acting as a framework of the backrest is pivotably attached to the seat frame.

6. A massage chair according to claim 1,
wherein the seat rail includes a first running groove, which is opened laterally and allows the seat frame to run therein, and
wherein the arm rail includes a second running groove, which is opened vertically and allows the arm support to run therein, and is stacked on the seat rail.

7. A massage chair according to claim 6,
wherein the seat frame includes a driving unit for moving the seat frame in the front-rear direction, and
wherein a back frame acting as a framework of the backrest is pivotably attached to the seat frame.

8. A massage chair according to claim 1,
wherein the seat frame includes a driving unit for moving the seat frame in the front-rear direction, and
wherein a back frame acting as a framework of the backrest is pivotably attached to the seat frame.

* * * * *